US011167337B2

(12) United States Patent
Perry et al.

(10) Patent No.: US 11,167,337 B2
(45) Date of Patent: Nov. 9, 2021

(54) SELF CUTTING WIRE BENDER

(71) Applicant: Pensa Labs, Inc., Brooklyn, NY (US)

(72) Inventors: Marco Perry, Brooklyn, NY (US); Oscar Frias, Brooklyn, NY (US)

(73) Assignee: Pensa Labs, Inc., Brooklyn, NY (US)

( * ) Notice: Subject to any disclaimer, the term of this patent is extended or adjusted under 35 U.S.C. 154(b) by 191 days.

(21) Appl. No.: 16/661,951

(22) Filed: Oct. 23, 2019

(65) Prior Publication Data

US 2020/0139422 A1 May 7, 2020

Related U.S. Application Data

(60) Provisional application No. 62/754,482, filed on Nov. 1, 2018.

(51) Int. Cl.
*B21F 1/00* (2006.01)
*B21F 11/00* (2006.01)

(52) U.S. Cl.
CPC ..... *B21F 1/006* (2013.01); *B21F 11/00* (2013.01)

(58) Field of Classification Search
CPC . B21F 11/00; B21F 1/00; B21F 1/006; B21D 7/02; B21D 7/022; B21D 7/024
USPC ..... 72/338
See application file for complete search history.

(56) References Cited

U.S. PATENT DOCUMENTS 1,630,064 A 5/1927 Fuchs
3,245,433 A 4/1966 Taylor
3,680,347 A 8/1972 Schenck
3,857,271 A 12/1974 Gott et al.
3,991,600 A 11/1976 Del Fabro
4,091,845 A 5/1978 Johnson
4,456,036 A * 6/1984 Rossi ..... B21F 1/00 140/105
4,798,073 A 1/1989 Dischler
5,088,310 A 2/1992 Anagnostopoulu
(Continued)

FOREIGN PATENT DOCUMENTS

JP 2003 071533 A 3/2003
WO 2016 054189 4/2016

OTHER PUBLICATIONS

Pensa Labs, "DIWire Bender," YouTube, May 2, 2012, [video online], Retrieved from the Internet: https://www.youtube.com/watch?v=velzzDXIJoA&t=1s.
(Continued)

*Primary Examiner* — Gregory D Swiatocha
*Assistant Examiner* — Bobby Yeonjin Kim
(74) *Attorney, Agent, or Firm* — DLA Piper LLP (US)

(57) ABSTRACT

A device for bending wire that includes a pin extending from an upper surface of a plate, a shaft extending through a center aperture of the plate and terminating in a bend head, a sleeve rotatably disposed around the shaft, a first motor for rotating the plate about the shaft, and a second motor configured to move the plate between extended, retracted and intermediate positions along the shaft. The plate positioned in the extended position and rotating causes the first pin to travel in front of a wire aperture of the bend head. The plate positioned in the intermediate and the retracted positions and rotating causes the first pin to travel underneath the wire aperture. The plate positioned in the retracted position causes the plate to engage with the sleeve such that rotation of the plate causes rotation of the sleeve.

22 Claims, 18 Drawing Sheets

(56) References Cited

U.S. PATENT DOCUMENTS

| | | | | |
|---|---|---|---|---|
| 5,203,192 | A | 4/1993 | Kimura | |
| 5,537,852 | A | 7/1996 | Del Fabro et al. | |
| 5,809,824 | A | 9/1998 | Hiltzman et al. | |
| 7,188,504 | B2 | 3/2007 | Latour | |
| 8,333,097 | B1 | 12/2012 | Frear | |
| 10,427,208 | B2 | 10/2019 | Perry | |
| 2014/0000335 | A1* | 1/2014 | Fries | B21D 7/024 72/362 |
| 2014/0130567 | A1 | 5/2014 | Christofillis | |
| 2017/0274442 | A1* | 9/2017 | Perry | B21F 1/00 |

OTHER PUBLICATIONS

Pensa Labs, "DIWire, Now On Kickstarter," YouTube, Dec. 6, 2013, [video online], [retrieved on Nov. 23, 2015], Retrieved from the Internet: URL:https://www.youtube.com/watch?v=0jG4SWcThBc.

* cited by examiner

SELF CUTTING WIRE BENDER

RELATED APPLICATIONS

This application claims the benefit of U.S. Provisional Application No. 62/754,482, filed on Nov. 1, 2018, and which is incorporated herein by reference.

FIELD OF THE INVENTION

The present invention relates to devices that bend wire into desired shapes.

BACKGROUND OF THE INVENTION

Wire benders are devices that bend wire into desired 2-dimensional or 3-dimensional shapes. Early wire benders provided a mechanism that allowed a user to manually bend wire into desired shapes. See for example U.S. Pat. Nos. 4,091,845 and 5,809,824. More recently, motorized wire benders have been developed that use a moving pin under motor control to bend wire, some even operating under computer control. See for example U.S. Pat. No. 5,088,310. Drawbacks of such devices, however, include excessive expense, complexity and size. Additionally, such devices are difficult to set up and operate for each desired wire shape, especially when the wire shape is completed and needs extraction from the wire feed (which traditionally is done manually by hand).

There is a need for a wire bender device design that is simple and relatively inexpensive and easy to operate, so that wire shapes can be effectively and efficiently created and extracted.

BRIEF SUMMARY OF THE INVENTION

The aforementioned problems and needs are addressed a device for bending wire that includes a plate (with upper and lower surfaces and a center aperture extending there between, and a first pin extending from the upper surface), a shaft extending through the center aperture and terminating in a bend head where the bend head includes a wire aperture configured to pass a wire and first and second bend surfaces positioned adjacent the wire aperture, a sleeve rotatably disposed around the shaft, a first motor configured to rotate the plate about the shaft in opposing first and second rotational directions, and a second motor configured to move the plate between an extended position and a retracted position, and an intermediate position there between, along the shaft. The plate positioned in the extended position and rotating in the first rotational direction causes the first pin to travel in front of the wire aperture. The plate positioned in the intermediate and the retracted positions and rotating in the first rotational direction causes the first pin to travel underneath the wire aperture. The plate positioned in the retracted position causes the plate to engage with the sleeve such that rotation of the plate in the first rotational direction causes rotation of the sleeve in the first rotational direction and rotation of the plate in the second rotational direction causes rotation of the sleeve in the second rotational direction.

The device for bending wire can include a plate (with upper and lower surfaces and a center aperture extending there between and a first pin extending from the upper surface), a shaft extending through the center aperture and terminating in a bend head where the bend head includes a wire aperture configured to pass a wire and first and second bend surfaces positioned adjacent the wire aperture, a sleeve rotatably disposed around the shaft, a first motor configured to rotate the plate about the shaft in opposing first and second rotational directions, a second motor configured to move the plate between an extended position and an intermediate position along the shaft, and a third motor configured to rotate the sleeve about the shaft in the opposing first and second rotational directions. The plate positioned in the extended position and rotating in the first rotational direction causes the first pin to travel in front of the wire aperture. The plate positioned in the intermediate position and rotating in the first rotational direction causes the first pin to travel underneath the wire aperture. The shaft includes a cavity therein in communication with second apertures in a sidewall of the shaft, and the sleeve including a cam surface facing the shaft. A plunger is disposed in the cavity and has a second cam surface and an upper surface. Ball bearings are each disposed in one of the apertures and between the cam surface and the second cam surface. Rotation of the sleeve in the first rotational direction causes the cam surface to move the ball bearings toward a center of the cavity of the shaft and engaging the second cam surface for driving the plunger upwardly in the cavity. Rotation of the sleeve in the second rotational direction causes the cam surface to allow the ball bearings to move away from the center of the cavity of the shaft for allowing the plunger to move downwardly in the cavity.

Other objects and features of the present invention will become apparent by a review of the specification, claims and appended figures.

DETAILED DESCRIPTION OF THE INVENTION

Figure 1:
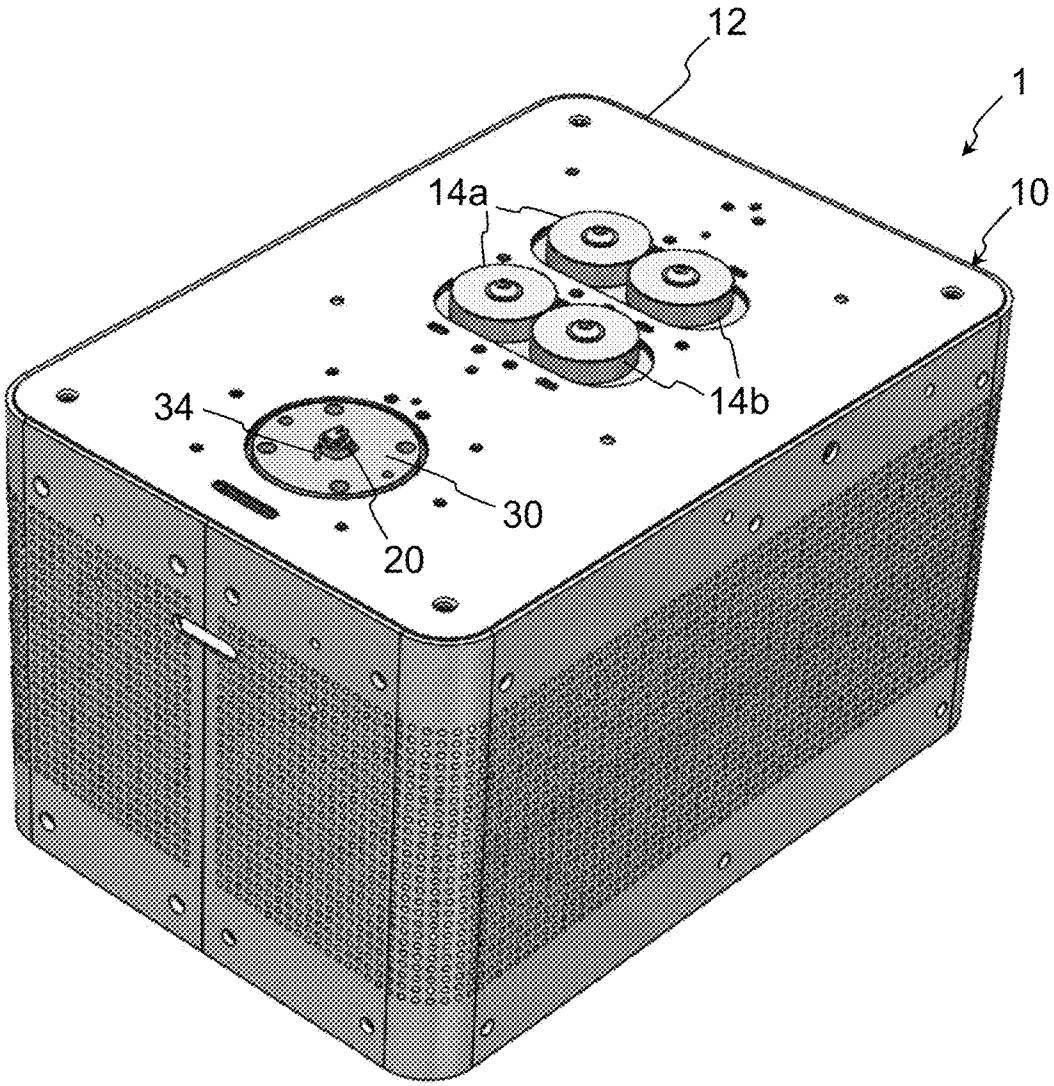
FIG. 1 is a perspective view of the wire bender apparatus.

The present embodiment is a desktop sized wire bender that converts drawn curves into bent wire having 2-dimensional or 3-dimensional shapes. The wire bender 1 is shown in FIG. 1, and includes a housing 10 having a top plate 12.

The top plate 12 serves as a work surface on which the wire manipulation components are positioned. These components include two pairs of feed wheels, with each pair including two wheels 14*a* and 14*b* that pinch and manipulate the wire fed there between.

Figure 2:
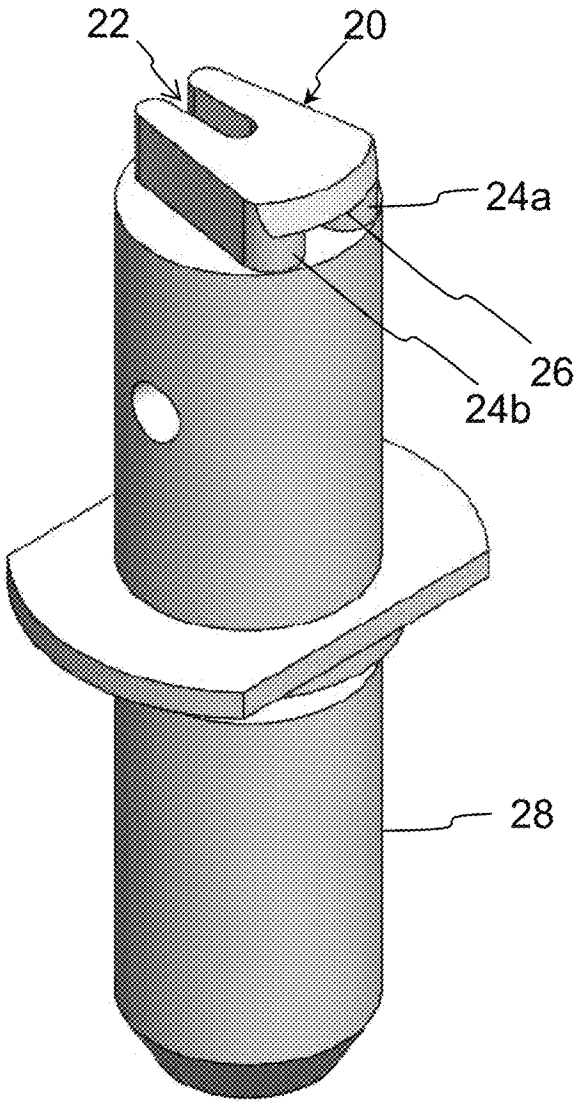
FIG. 2 is a perspective view of the bend head and shaft.

A bend head 20 is positioned to receive the wire fed from the pairs of feed wheels. The bend head 20 is better shown in FIG. 2, and includes an aperture 22 through which the wire can be fed to hold the wire in place while it is being bent. Bend head 20 also includes a pair of bend surfaces 24*a* and 24*b*, one on each side of the aperture 22. Above the aperture 22 and between the bend surfaces 24*a*/24*b* is a cutting edge 26 (preferably enhanced by a less than 90 degree angle between the top surface of the aperture and the side wall which defines the cutting edge). The bend head 20 is positioned at the top of a shaft 28.

Figure 3:
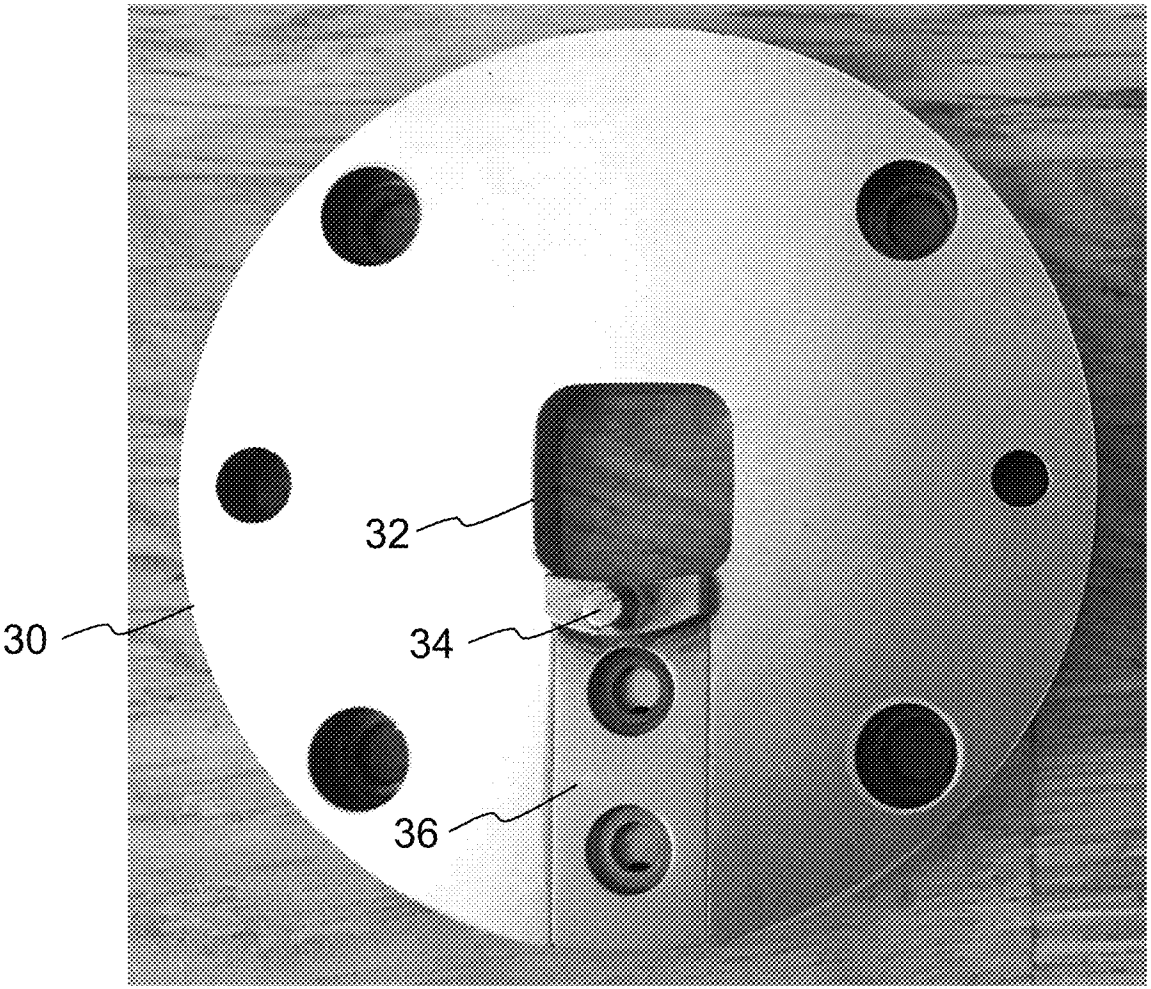
FIG. 3 is a top view of the rotatable plate.
Figure 4:
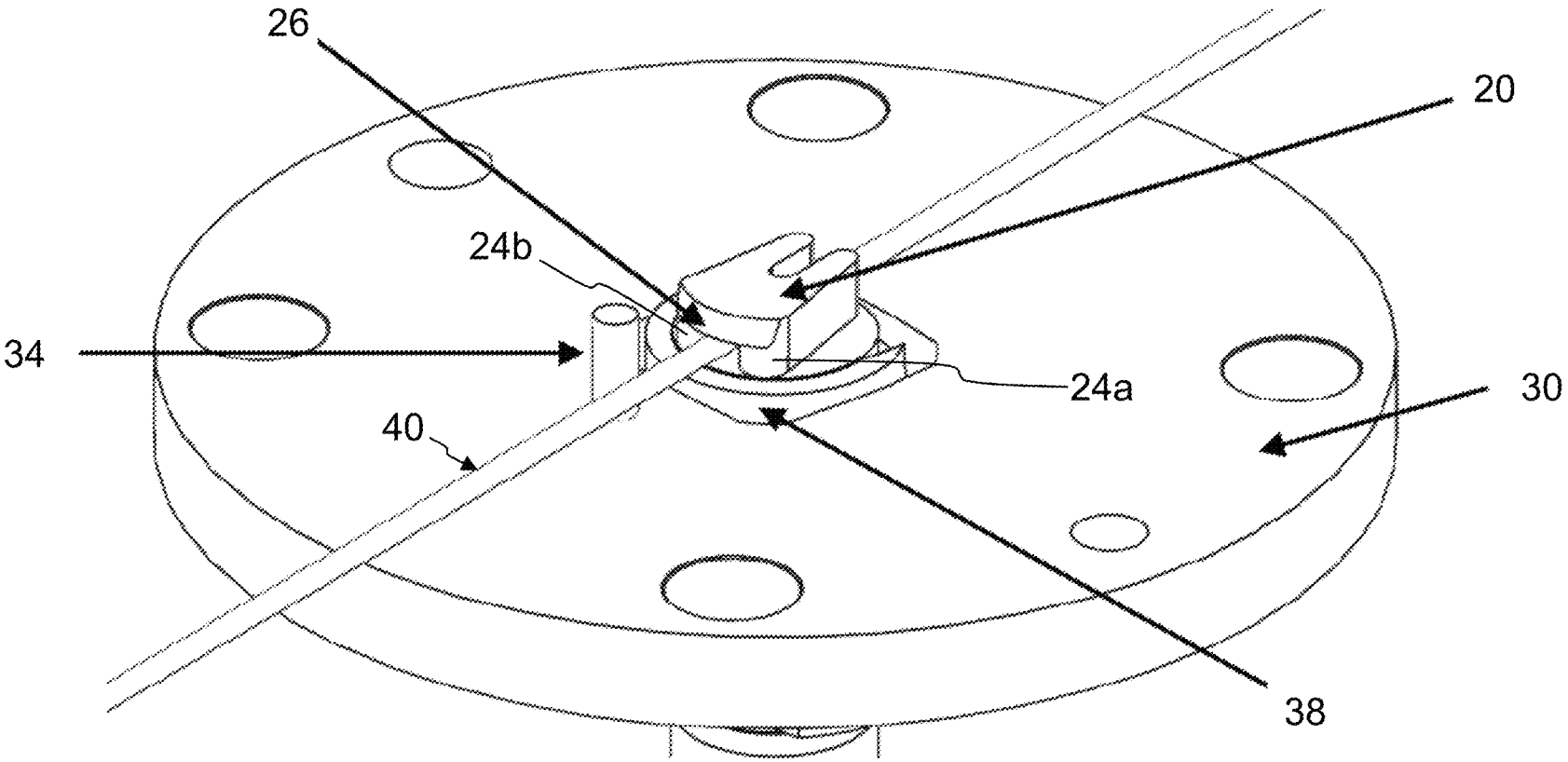
FIG. 4 is a perspective view of the bend head and rotatable plate.

Shaft 28 protrudes through a center aperture 32 of a plate 30, as best shown in FIGS. 3-4. Plate 30 preferably has a circular out edge. Plate 30 includes an upwardly protruding pin 34 closely adjacent the aperture 32. Pin 34 can be integrally formed as part of plate 30, or part of an assembly that mounts to plate 30 as best shown in FIG. 3. Pin 34 travels (translates) in an arch shape path relative to the bend head 20 by rotation of the plate 30 about its center aperture 32. Shaft 28 also protrudes through a hollow sleeve 38 to be explained in further detail below.

Figure 5B:
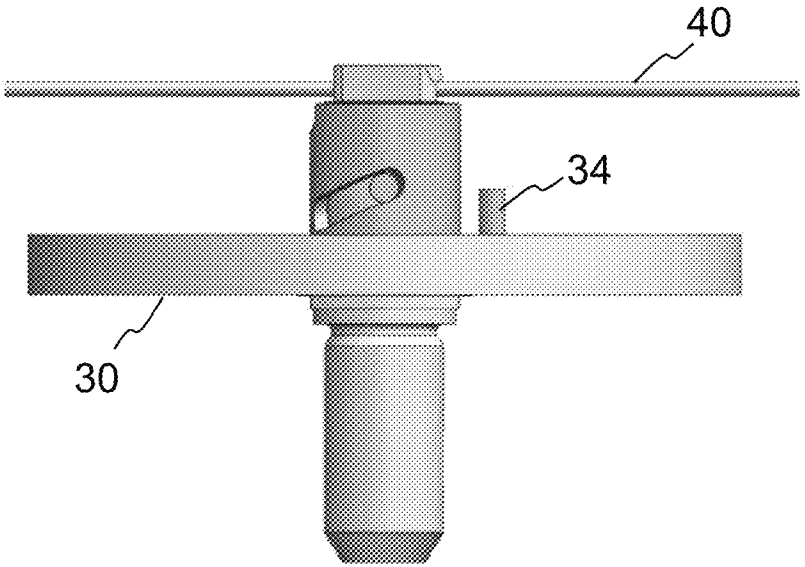
FIG. 5B is a side view of the rotatable plate in its retracted position.
Figure 5A:
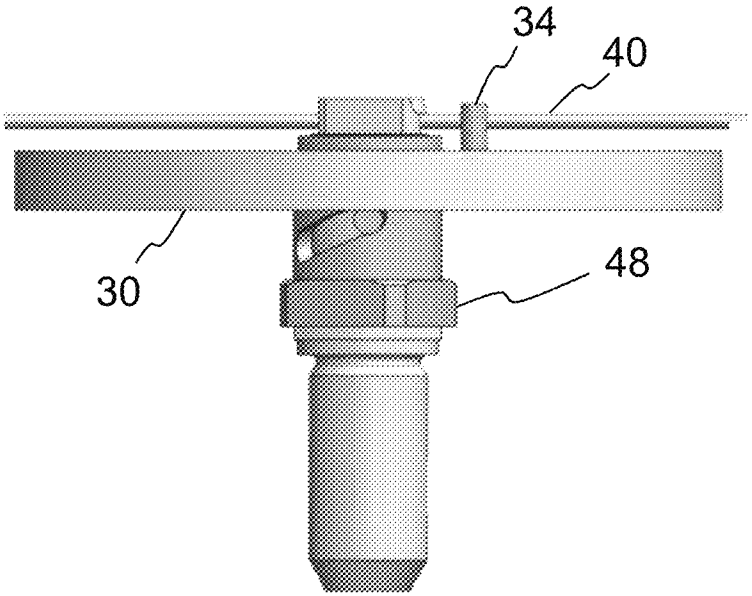
FIG. 5A is a side view of the rotatable plate in its extended position.

FIG. 4 shows wire 40 extending through the aperture 22 of bend head 20 and out beyond the bend surfaces 24*a*/24*b*. The pin 34 is shown positioned at the point it makes initial contact with the wire 40. The plate 30 is then rotated counterclockwise from the position shown in FIG. 4, which causes the pin 34 to travel in front of aperture 22 and push on wire 40 (wrapping the wire 40 around bend surface 24*a*) until the desired bend shape is achieved in the wire. At that point, pin 34 retreats away from wire 40 by rotating plate 30 in the opposite direction. Thereafter, the wire 40 is advanced by the feed wheels 14*a*/14*b* to the next target location of the wire to be bent. To implement bends in the opposite direction, the plate 30 lowers vertically down to a semi-retracted (intermediate) position so that the pin 34 can travel underneath the aperture 22 and therefore underneath the wire without engaging it, where plate 30 then rises vertically to its raised (extended) position and rotates clockwise so that pin 34 passes in front of the aperture 22 and engages wire 40 from the other side and pushes on wire 40 (wrapping the wire around bend surface 24*b*) until the desired bend shape is achieved in the wire. FIG. 5A shows the plate 30 in its raised (extended) position (where pin 34 will engage with and bend wire 40 upon rotation of the plate 30). FIG. 5B shows the plate 30 in a fully retracted position used for cutting as further described below. The intermediate position is between those shown in FIGS. 5A and 5B.

Figure 6:
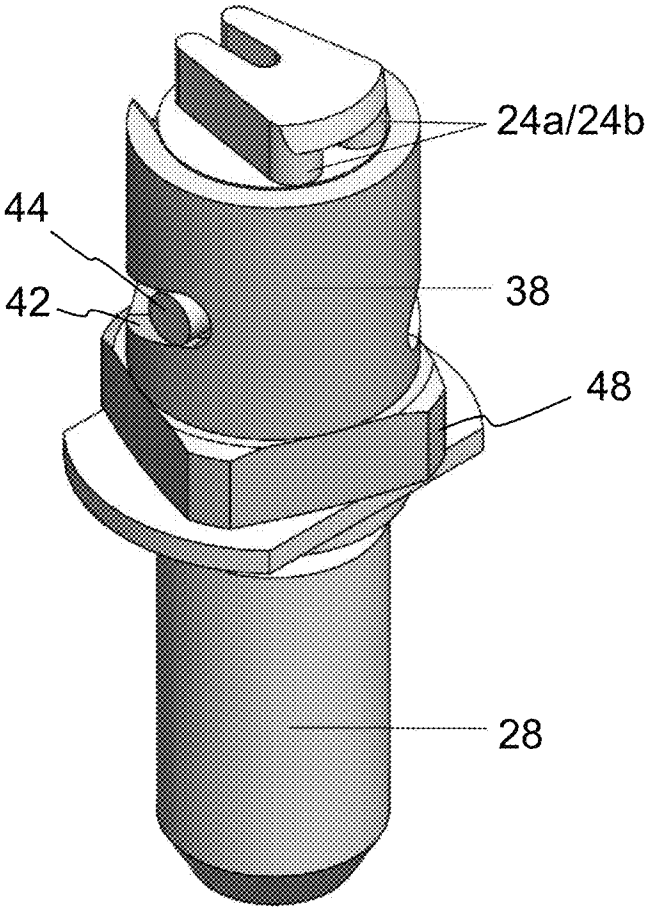
FIG. 6 is a perspective view of the sleeve mounted around the shaft.
Figures 7A, 7B, 7C:
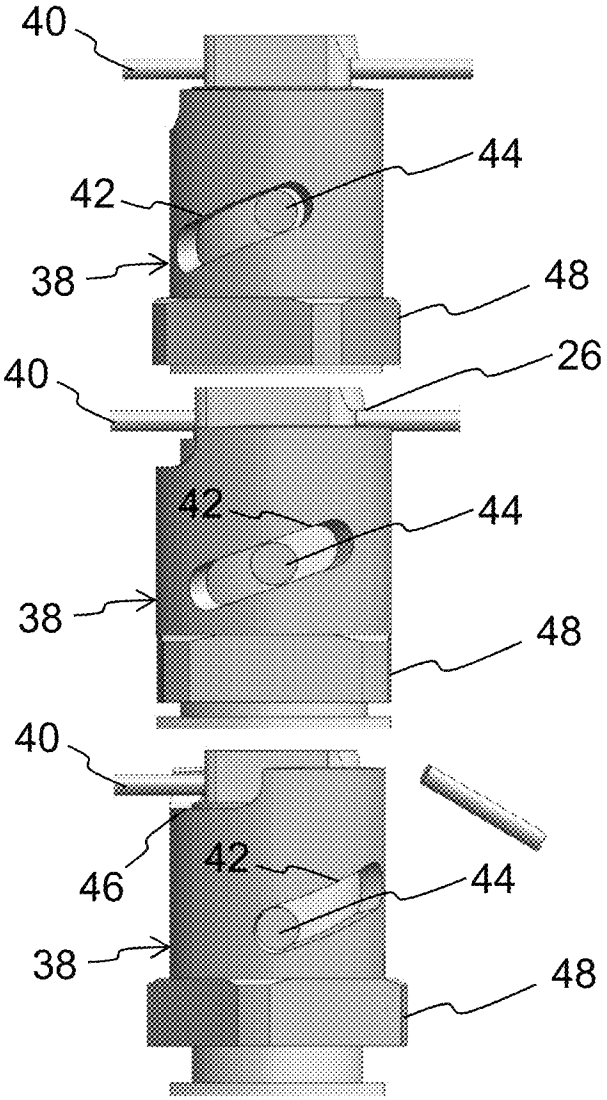
FIGS. 7A-7C are side views showing the different vertical positions of the sleeve relative to the shaft.

FIG. 6 shows that shaft 28 is disposed inside of sleeve 38, which rotates about shaft 28. Sleeve 38 includes a sloping cam slot 42 which engages with a cam pin 44 extending out of shaft 28. Rotation of the sleeve 38 about shaft 28 in one direction causes pin 44 to engage with the upper sloping side of cam slot 42 to move the sleeve upwardly relative to the shaft 28 (from a retracted position to an extended position). Rotation of the sleeve 38 about shaft 28 in the other direction causes pin 44 to engage with the lower sloping side of cam slot 42 to move the sleeve downwardly relative to the shaft 28 (from the extended position to the retracted position). FIG. 7A shows sleeve 38 in the retracted position. FIG. 7B shows sleeve 38 in its intermediate position (e.g., traveling from the retracted position to the extended position). FIG. 7C shows sleeve 38 in the extended position. As the sleeve reaches the extended position, the sleeve's top edge engages with the wire 40 extending out of the aperture 22, pressing it against cutting edge 26, which cuts the wire off as the top edge of sleeve 38 passes cutting edge 26 (as shown in FIG. 7C). The top edge of sleeve 38 includes a notch or recess 46 so that the sleeve does not engage the portion of the wire feeding into the other side of aperture 22. This configuration is advantageous because it cuts the wire at a location directly adjacent the bend surfaces 24*a*/24*b*, which is ideal for those desired wire shapes where the wire is to end and be cut at or very near the last bend shape. This cutting capability provides accurate cutting, and means that the user need not manually cut the wire which could be time consuming and inaccurate.

Rotation of sleeve 38 is accomplished by lowering plate 30 to its retracted position so that its center aperture 32 engages with a flange 48 of sleeve 38. Aperture 32 and flange 48 have shapes that match each other sufficiently so that rotating plate 30 causes aperture 32 engaged with flange 48 to rotate sleeve 38. The non-limiting example in the figures shows aperture 32 having a generally square shape matching a generally square shape of the lower portion of flange 48. This configuration is advantageous because the same motor used to rotate plate 30 for bending wire 40 can also be used to rotate and raise sleeve 38 for cutting wire 40.

Figure 8:
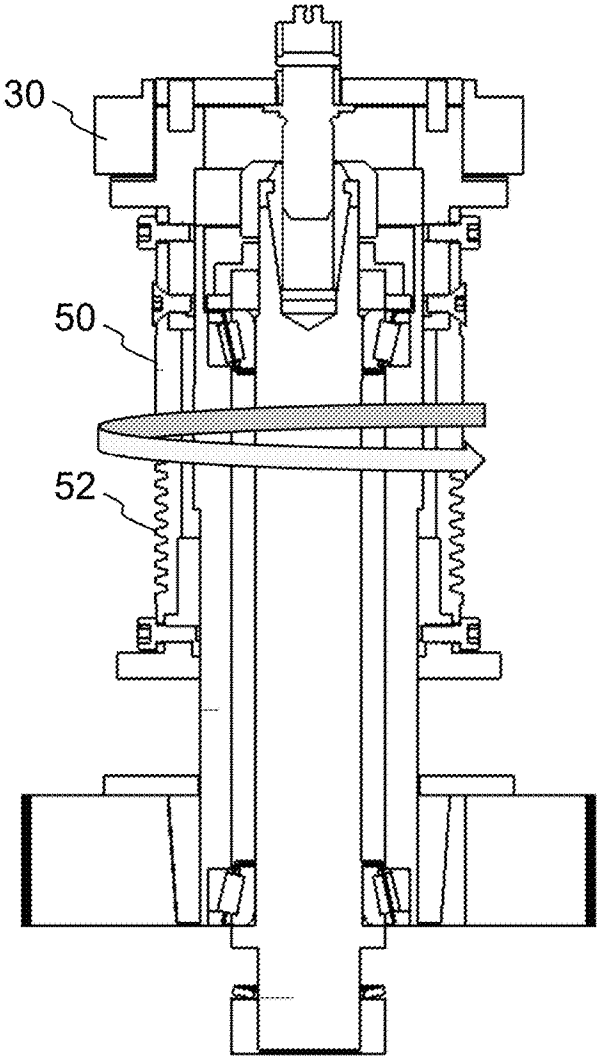
FIG. 8 is a side cross sectional view of the components used to raise and lower the rotatable plate.
Figure 9:
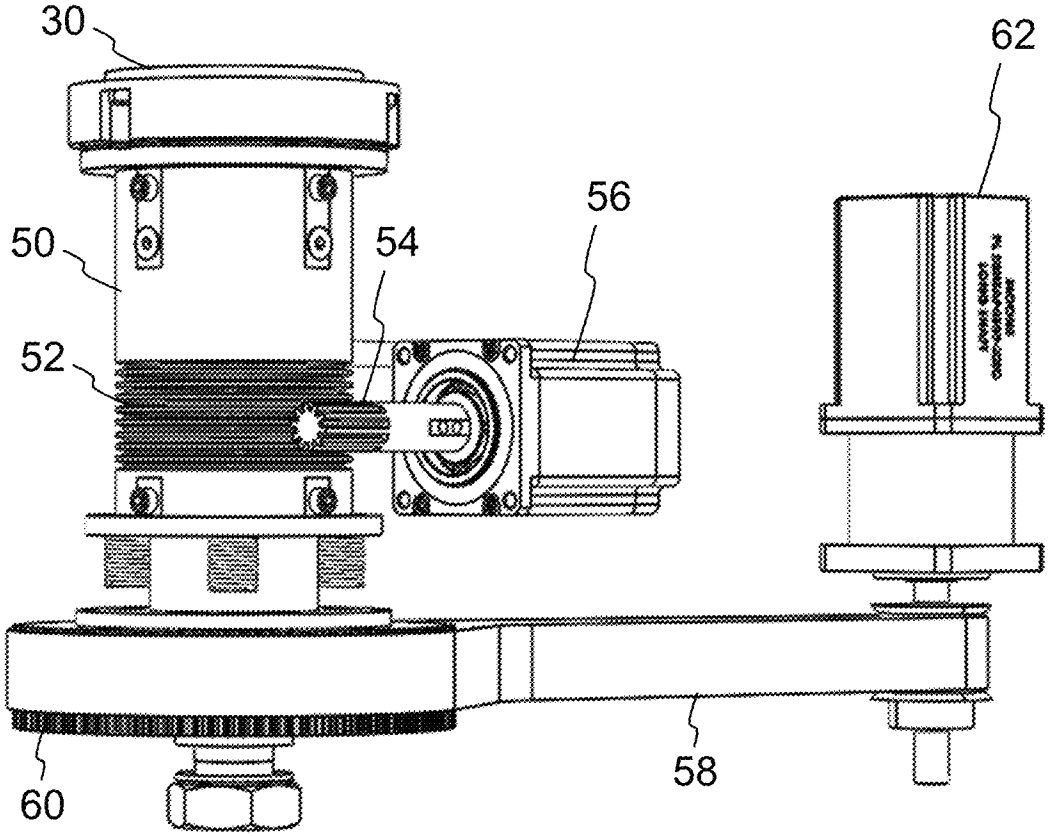
FIG. 9 is a side view of the components used to raise, lower and rotate the rotatable plate.
Figure 10:
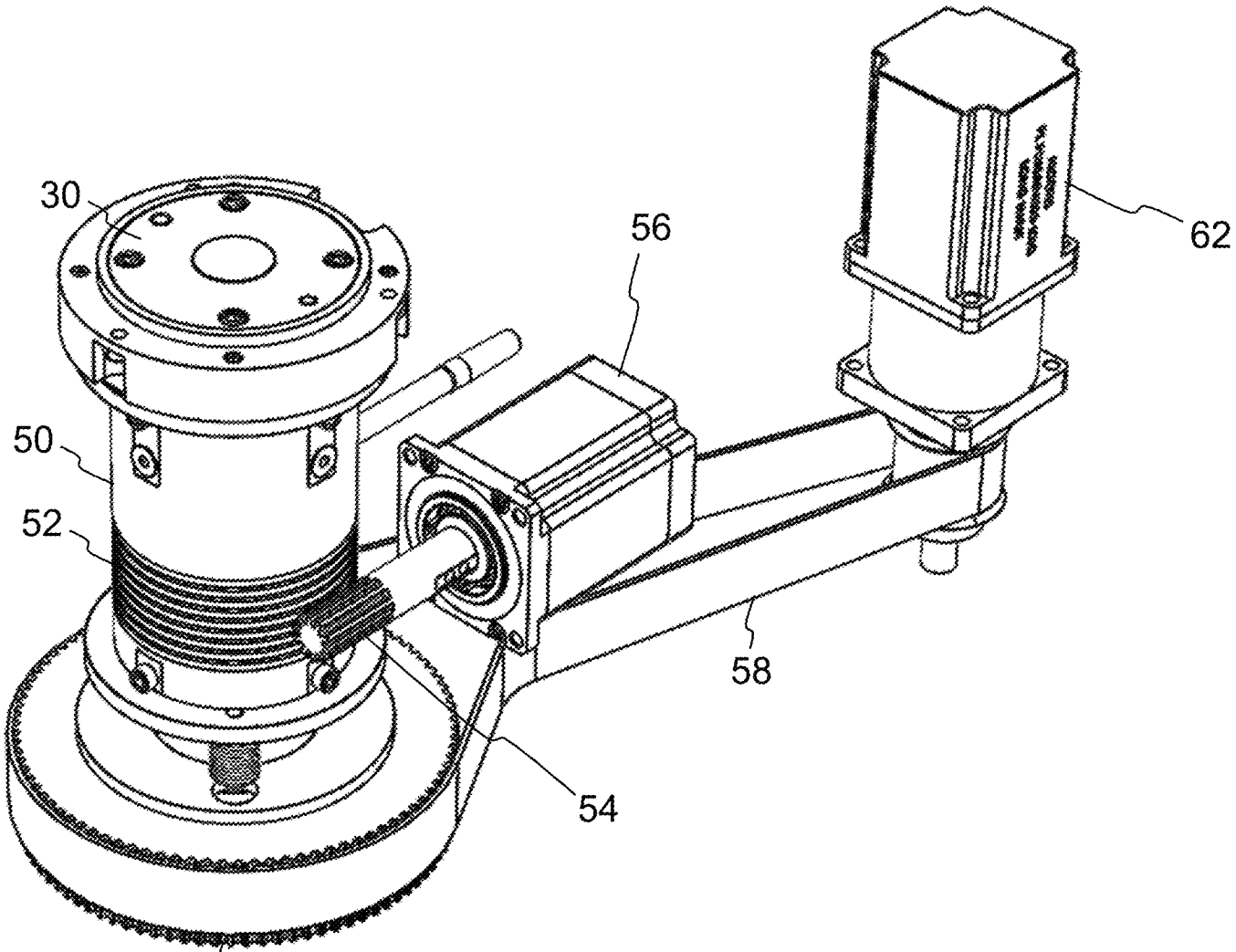
FIG. 10 is a perspective view of the components used to raise, lower and rotate the rotatable plate.

FIGS. 8-10 illustrates the structure used to raise and lower plate 30, and rotate plate 30. The plate 30 is connected to sleeve 50 that includes teeth 52 on its outer circumference. Gear 54 is engaged with teeth 52 and is driven by motor 56 to drive sleeve 50 and plate 30 vertically between three positions (a fully raised position so that pin 34 engages with wire 40, a semi-retracted position that allows the pin to pass underneath the wire without engaging it, and a fully retracted position wherein plate aperture 32 engages with sleeve flange 48 for rotating and raising sleeve 38 for cutting the wire. Rotation of plate 30 is provided by belt 58 which is engaged with sleeve 50. Preferably, belt 58 is a toothed timing belt that engages with a toothed pulley 60 connected to the sleeve 50. Motor 62 drives belt 58 to rotate sleeve 50 and plate 30. This means that three actions (raising/lowering plate 30, rotating plate 30, and rotating sleeve 38 for vertical movement) are accomplished using only two motors, driving down the complexity, size and cost of the wire bender 1. Moreover, teeth 52 preferably extend around the entire circumference of sleeve 50, so that the raising/lowering of plate 30 can be performed independently and concurrently with rotation of plate 30 (e.g., so that the plate 30 can maintain engagement with the rising flange 48 as sleeve 38 travels vertically up and down).

Figure 13:
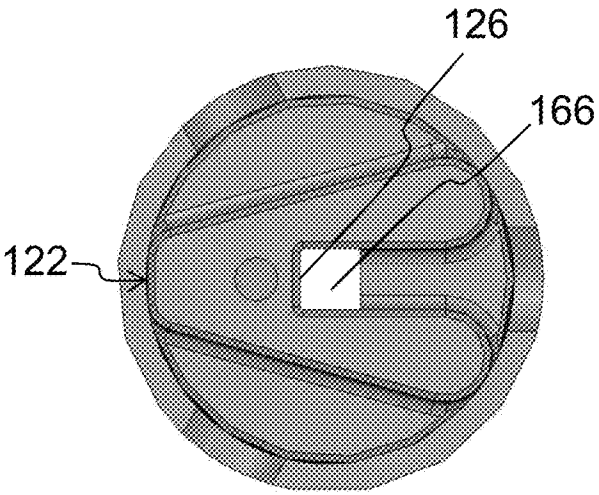
FIG. 13 is a top view of the bend head of the alternate embodiment.
Figure 12:
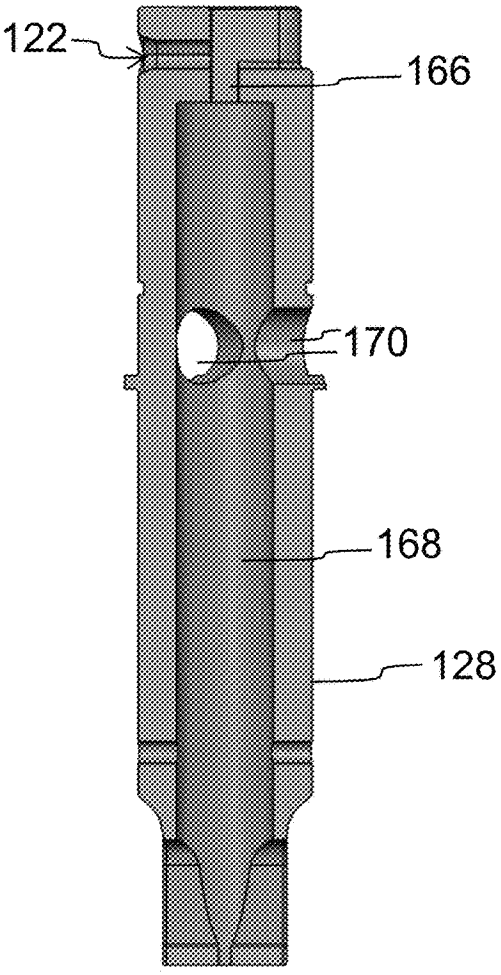
FIG. 12 is a side cross sectional view of the bend head and shaft of the alternate embodiment.
Figure 11:
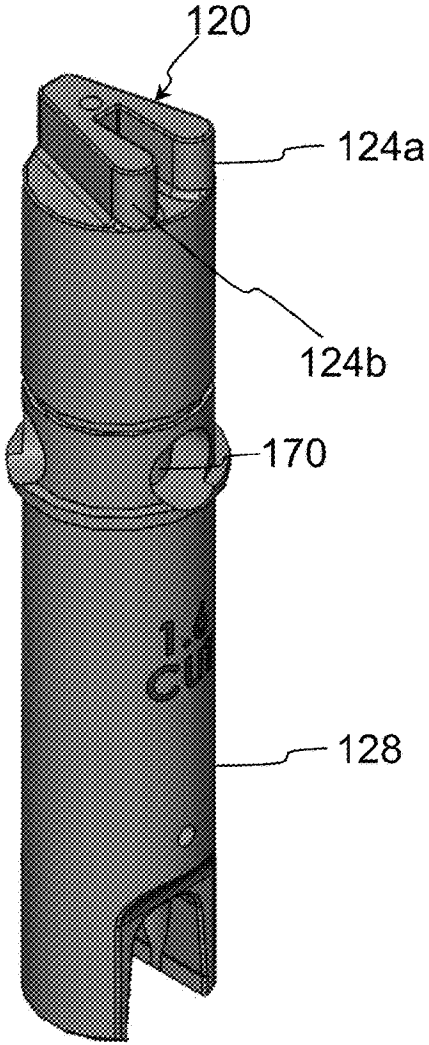
FIG. 11 is a perspective view of the bend head and shaft of an alternate embodiment.
Figure 14:
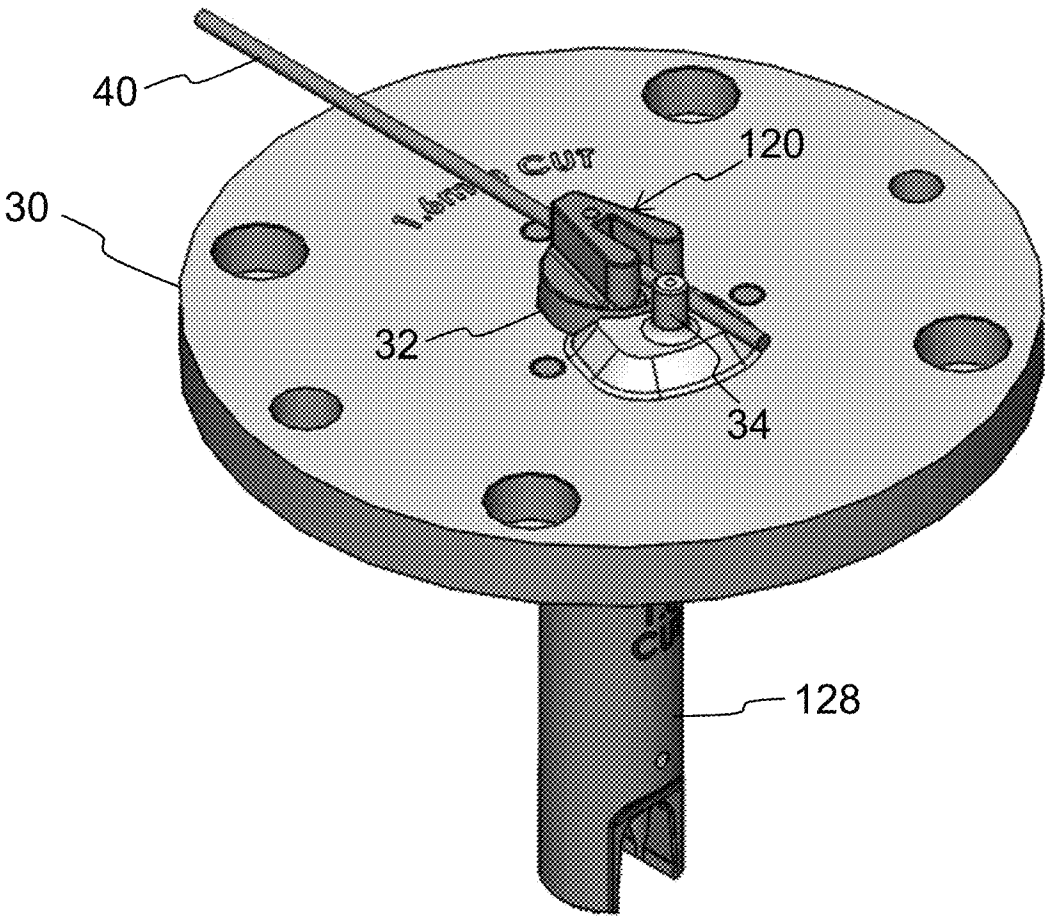
FIG. 14 is a perspective view of the bend head and rotatable plate of the alternate embodiment.
Figure 23:
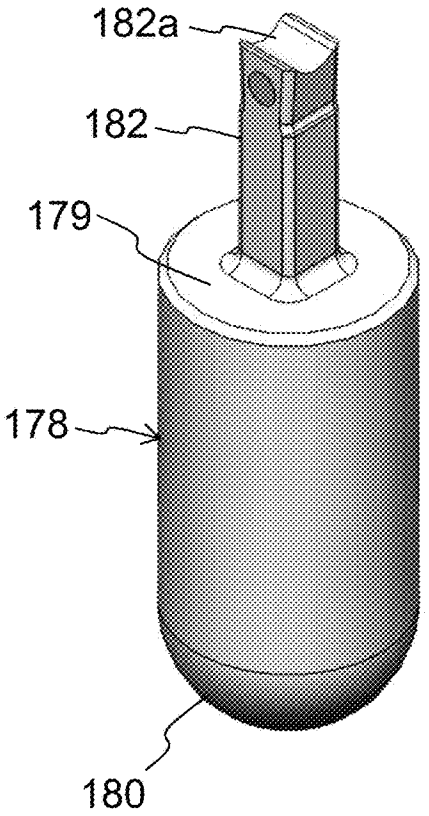
FIG. 23 is a perspective view of the plunger of the alternate embodiment.
Figure 15:
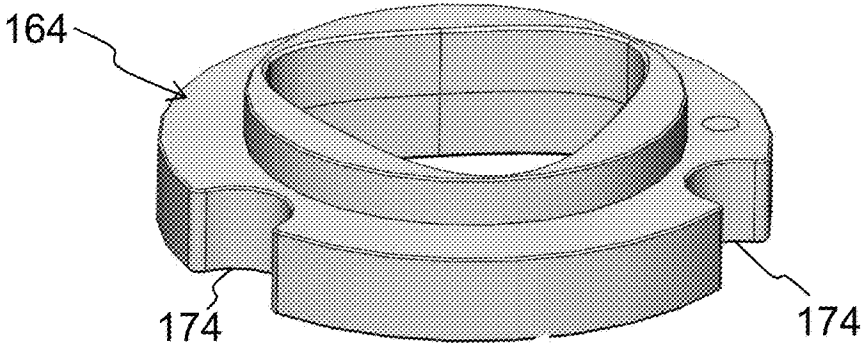
FIG. 15 is a perspective view of the rotatable sleeve of the alternate embodiment.
Figure 16:
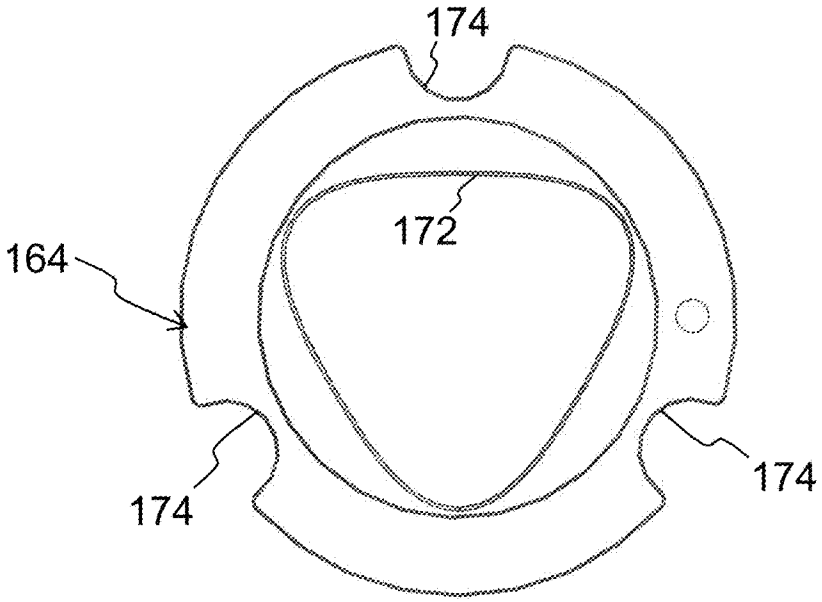
FIG. 16 is a top view of the rotatable sleeve of the alternate embodiment.

FIGS. 11-22 illustrate an alternate embodiment which also utilizes the rotation of the plate 30 to perform the wire cutting. FIGS. 11-13 show the bend head 120 which is similar to bend head 20, except the cutting edge 126 is spaced further back from the bend surfaces 124*a*/124*b* and adjacent a center aperture 166 that meets wire aperture 122. The bend head 120 is positioned at the top of a shaft 128. Shaft 128 protrudes through center aperture 32 of plate 30, as best shown in FIG. 14. Shaft 128 is hollow and has an interior cavity 168 that is in communication with center aperture 166 and with apertures 170 formed in the sidewall of shaft 128, as best shown in FIGS. 11-12. Three apertures 170 are shown, but the number can vary.

A sleeve 164 having an irregularly shaped interior sidewall 172 is rotatably disposed around shaft 128 and over apertures 170, as best shown in FIGS. 15-19. The outer surface of sleeve 164 includes cavities 174 formed therein. Three cavities 174 are shown and are in the form of open notches, but the number can vary and they could be fully enclosed holes. The plate 30 includes pins 176 extending down from its lower surface for engaging with cavities 174 as described further below. Three pins 176 are shown, but the number can vary. A plunger 178 is disposed inside the interior cavity 168 of shaft 148, as best shown in FIGS. 20B-22B and 23. Plunger 178 includes a rounded bottom surface 180 and an upwardly extending pin 182 that protrudes through aperture 166 of the bend head 120. Pin 182 preferably includes a concave top surface 182*a* for engaging wire 40. A spring 184 is disposed inside cavity 168 of shaft 128 and provides a downward resilient force on the plunger 178 (e.g., the spring presses downwardly on a shoulder 179 of plunger 178 from which pin 182 extends). Ball bearings 186 are disposed in apertures 170 of shaft 128, and between (and in contact with) the interior sidewall 172 of sleeve 164 and the rounded bottom surface 180 of plunger 178, as best shown in FIGS. 20A-22A. Three ball bearings 186 are shown, but the number can vary.

Figure 19:
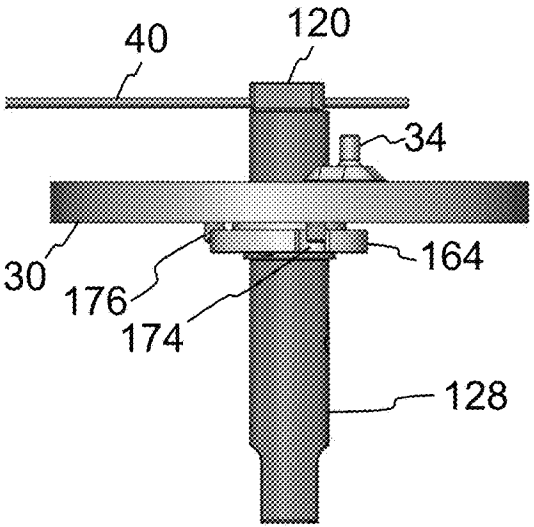
FIGS. 17-19 are side views of the rotatable plate in its extended, intermediate and retracted positions, respectively.
Figure 18:
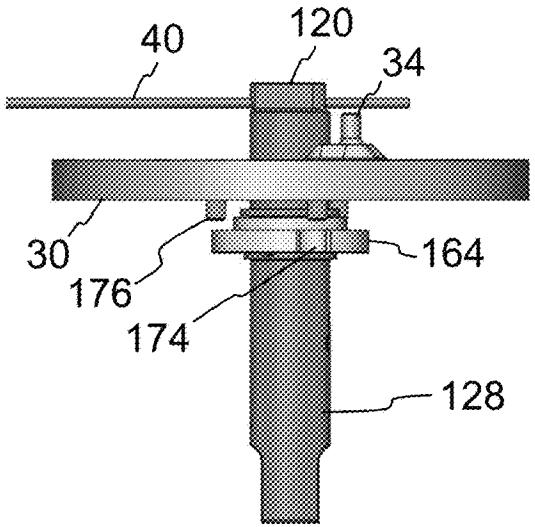
Figure 17:
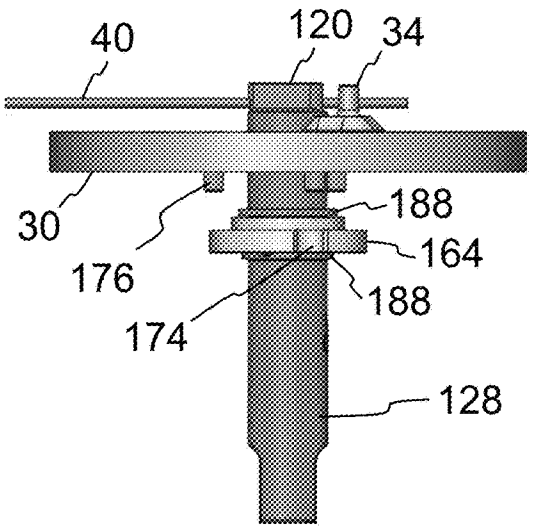
Figure 20A:
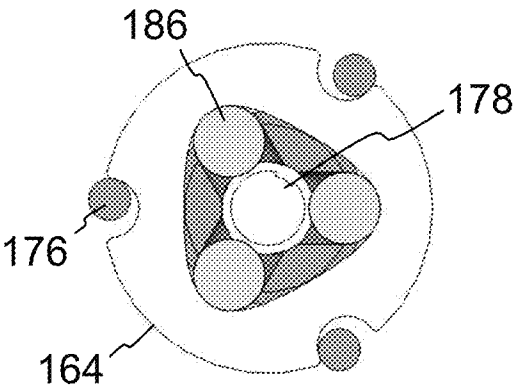
FIGS. 20A and 20B are top and side cross sectional views of the plunger in its lowest position.
Figure 21A:
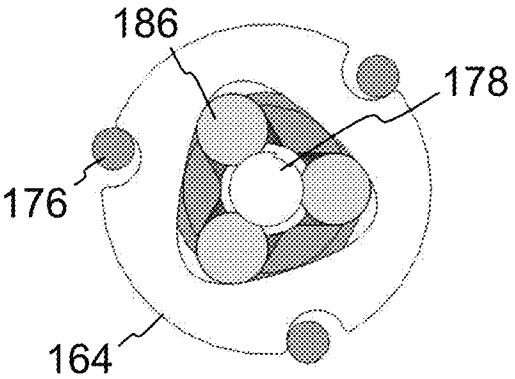
FIGS. 21A and 21B are top and side cross sectional views of the plunger in its intermediate position.
Figure 22A:
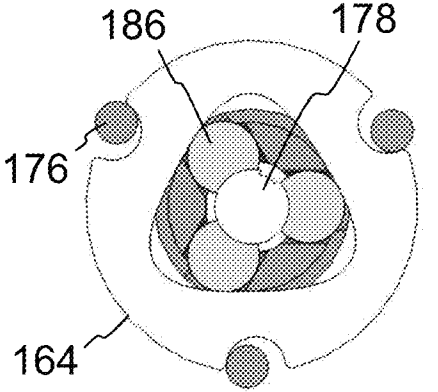
FIGS. 22A and 22B are top and side cross sectional views of the plunger in its raised position.
Figure 20B:
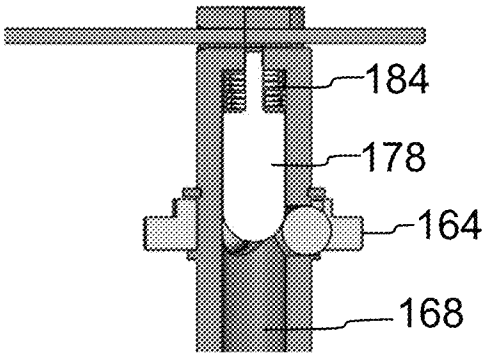
Figure 21B:
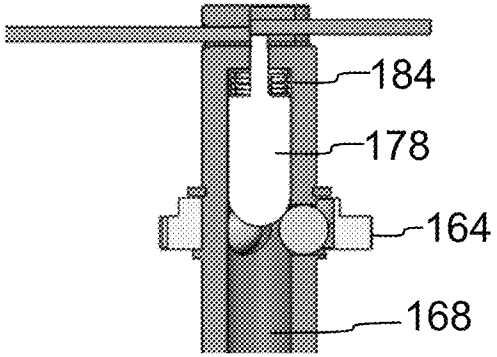
Figure 22B:
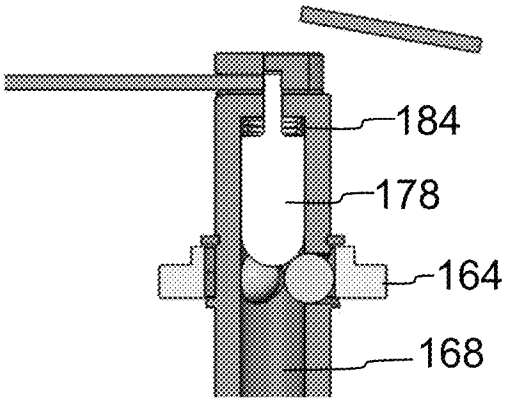
Figure 24C:
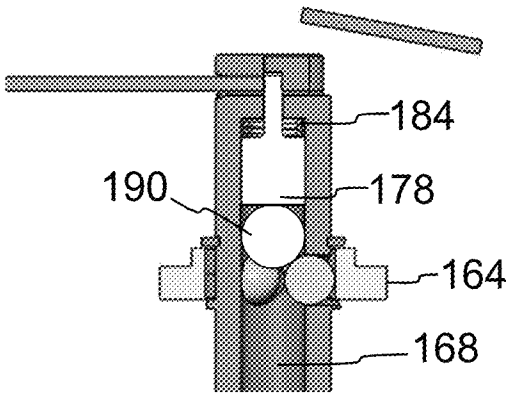
FIGS. 24A-24C are side cross sectional views of another embodiment of the plunger in its different positions.
Figure 24B:
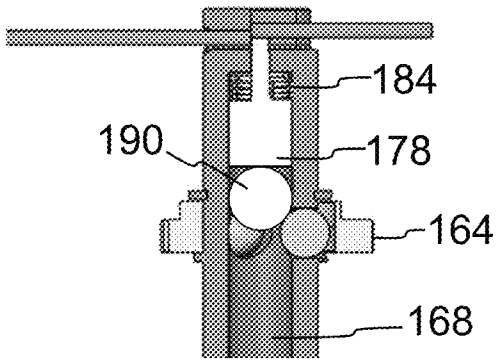
Figure 24A:
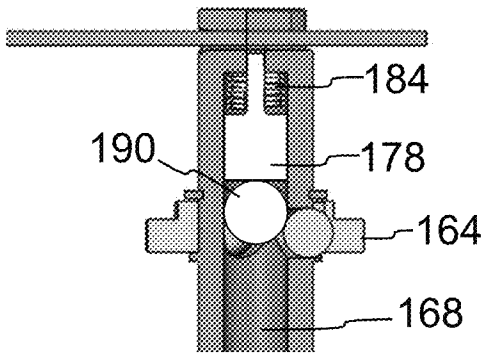

FIG. 17 shows the plate 30 in its raised/extended position (where pin 34 will engage with and bend wire 40 upon rotation of the plate 30). FIG. 18 shows the plate 30 in the intermediate position (where pin 34 can pass underneath the wire 40 without engaging it upon rotation of the plate 30). FIG. 19 shows the plate in a fully retracted position (where pins 176 of plate 30 engage with cavities 174 of sleeve 164 so that sleeve 164 is rotated by the rotation of plate 30).

As with the previous embodiment, rotation of the plate 30 is used to both bend the wire and to cut the wire. This is achieved by a ball and cam mechanism that translates the radial torque of the plate 30 to a vertical force in the upward direction on the plunger 178. The wire 40 is then cut by simple shearing action between the pin 182 of the plunger 178. Specifically, in the present embodiment, shaft 128 houses plunger 178, ball bearings 186 and spring 184. Sleeve 164 rotates around shaft 128 and is constrained axially by retaining rings 188. The shaft 128 is fabricated preferably out of tool steel alloys to ensure durability and strength. Plunger 178 and rotating sleeve 164 are fabricated of tool steels or high alloy steels suitable for the high pressures and stresses that will be present. Ball bearings 186 are either made of steel alloys or ceramics from any of the different carbide families. These material selections are examples and not intended to be limiting.

The cam and ball design allows for 3 different heights for operation for plate 30. The raised/extended position of plate 30 positions pin 34 to engage with and bend the wire 40 (see FIG. 17). The intermediate position of plate 30 allows pin 34 to pass under the wire 40 without engaging the wire, and without any cutting action (see FIG. 18). The retracted position of plate 30 causes pins 176 of plate 30 to engage with cavities 174 of sleeve 164 so that subsequent rotation of plate 30 causes rotation of sleeve 164 (see FIG. 19).

When the plate 30 is in the retracted position and rotates, it rotates sleeve 164 engaged therewith, causing the sleeve 164 to press inwardly on ball bearings 186. Specifically, the interior sidewall 172 of sleeve 164 is a cam surface having a tri-lobe or rounded triangle shape, and translates pure rotation of the plate 30 into radial travel of the ball bearings as seen in FIGS. 20A-22A. This geometry also determines both the amount of inwards radial travel of the ball bearings and the mechanical advantage with which the bending torque of plate 30 is converted into inwards radial force on the ball bearings. Therefore, the geometry of the tri-lobe cam surface 172 can be optimized for specific travels or forces required at the plunger.

When the ball bearings 186 move inwards under the force exerted by cam surface 172, the ball bearings 186 press with equal force against the rounded bottom surface 180 of plunger 178 (i.e., a second cam surface), which in turn forces the plunger 178 to travel upwards, as shown in FIGS. 20B-22B. The round on round interface between the round ball bearings 186 and rounded bottom surface 180 of plunger 178 minimizes friction and maximizes mechanical advantage on the upwards motion, which allows the mechanism to apply enough force to cleanly cut the wire using shearing action. The upward motion of the plunger causes the plunger's pin 182 to engage with and cut wire 40 by a shearing action with cutting edge 126 of bend head 120 (see FIG. 22B). The cutting action causes the cut wire to naturally eject itself due to the induced shearing stresses. After cutting, the plate 30 is rotated in the opposite direction so that the plunger 178 and its pin 182 return to its resting position under the resilient force of spring 184 (see FIG. 20B). This spring-induced retraction force also forces the ball bearings 186 to fully retract outwards until they come to rest on the corners of the tri-lobe features of the rotating sleeve's cam surface 172. The spring 184 can be either a compression spring, a tension spring, a constant force spring, or a combination of. Once the rotating sleeve 164 has come to its resting position (FIGS. 20A and 20B), the plate 32 can be lifted to either the intermediate position (FIG. 18) for pin positioning or the extended position for wire bending (FIG. 17).

The number of ball bearings 186 can vary, but having three ball bearings 186 pushing out into the cavities of a tri-lobe cam surface 172 presents the secondary advantage of achieving high angular repeatability of the resting position of the rotating sleeve 164, which then enables a manufacturer to automate a cutting sequence, in the case of a CNC machine, knowing that the rotating sleeve 164 will always be accurately found in a specific position for engagement.

The ball bearings 186 are housed in three equally spaced apertures 170 shown in FIGS. 11-12, bored in the body of the shaft 128. The size and surface finish of these holes affect the friction losses of the mechanism for which special provisions should be taken to ensure the free fit and free motion of the ball bearings 186 through the apertures 170. The plunger 178 is shown to have a rounded bottom surface 180 for engaging with ball bearings 186. However, bottom surface 180 could instead have a different shape, such as conical, convex, or pyramidal. Alternatively, the bottom surface of plunger 178 could be flat and rest on a larger ball bearing 190 disposed in the cavity 168 of shaft 128 that is engaged with the smaller ball bearings 186, as shown in FIG. 23A-23C. During the cutting motion, the plunger 178 travels upwards inside the cavity 168 bored concentrically into the shaft 128, which has been machined and finished to a size that allows for free motion but with limited clearance such that the plunger 178 cannot rock or tilt beyond acceptable ranges.

Preferably both the plunger's pin 182 and the aperture 166 through which it extends have rectangular cross sections, which allow for vertical motion with limited friction, yet prevents any rotation of the plunger 178. The concave upper surface 182*a* of the plunger's pin 182 preferably matches or closely resembles the shape of the wire being cut to achieve a shearing action that is closer to a quill-on-quill system. Both the relief and contour can be added and tuned to optimize the quality of the cut, minimize or eliminate flash and burrs, and improve the durability of the plunger. As stated above, the rotating sleeve 164 could have more or less lobes than the three shown in the figures, depending on how many ball bearings 186 are used to distribute the loads. While plate 30 has pins 176 engaging with cavities 174 in sleeve 164, the opposite configuration could be implemented (i.e., pins extending from sleeve 164 could engage with cavities (i.e., holes) in plate 30). The number of pins 176 can vary from less than three (i.e., 1 or 2) or greater than 3.

All of the above described embodiments can use the same two motors and related features as described above with respect to the first embodiment of FIGS. 1-10 for vertically moving the plate, and for rotating the plate for wire bending and cutting, along with other features useable in operation (e.g., housing 10, top plate 12, feed wheels 14, etc.).

Figure 25A:
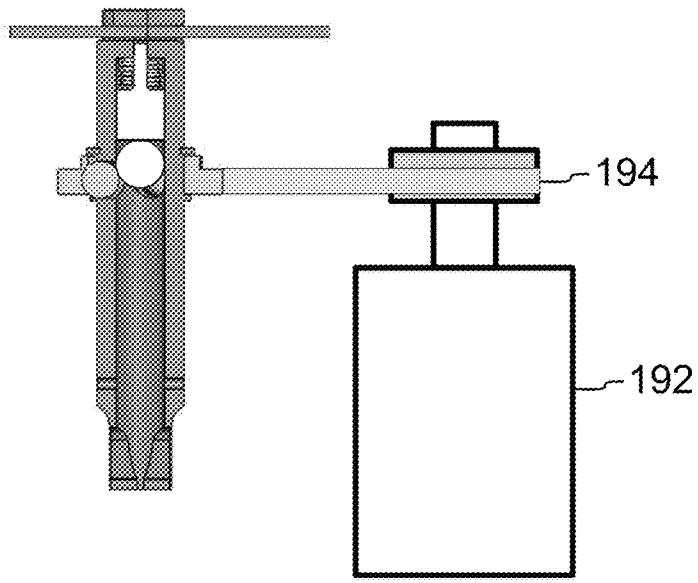
FIGS. 25A-25B are side and top cross sectional views of another embodiment having a motor and belt for rotating the sleeve.
Figure 25B:
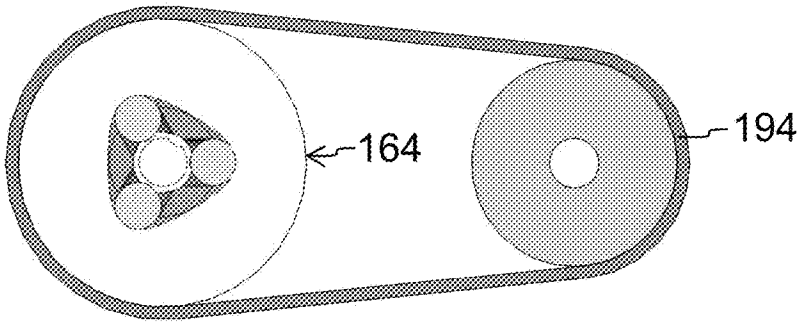

FIGS. 25A-25B illustrate a further embodiment, where a third motor is used to rotate sleeve 164 for driving plunger 178, thereby negating the need for the plate 30 to have a fully retracted position in which the plate 30 engages with the sleeve 164. Instead, a third motor 192 (separate from motor 56 used to raise/lower plate 32 and motor 62 used to rotate plate) is configured to rotate sleeve 164 via belt 194. With this embodiment, sleeve cavities 174 and pins 176 are omitted. Spring 184 can remain to assist the motor 192 in driving the plunger 178 downward, or can be omitted as well. While the use of motor 192 is shown with flat bottomed plunger 178 and ball bearing 190, the motor 192 and belt 194 configuration can also be used with plunger 178 with rounded bottom surface 180 and no ball bearing 190 as well.

Figure 26A:
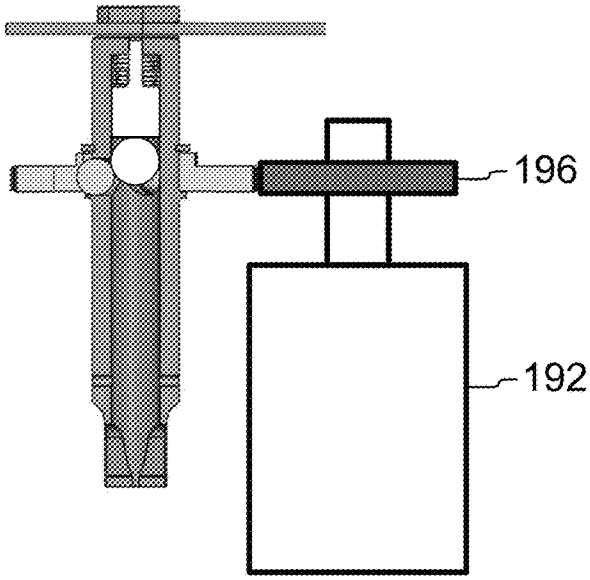
FIGS. 26A-26B are side and top cross sectional views of another embodiment having a motor and gear for rotating the sleeve.
Figure 26B:
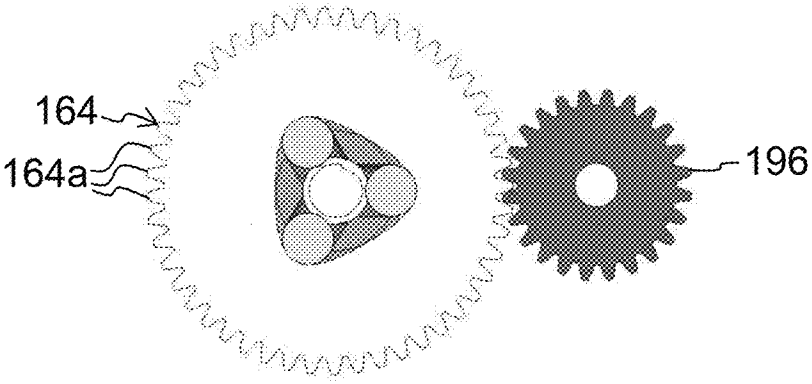

FIGS. 26A-26B illustrate a further embodiment, which is the same as the embodiment of FIGS. 25A-25B, except instead of using a belt, a gear 196 rotated by motor 192 engages with teeth 164*a* formed on the surface of sleeve 164 for rotating sleeve 164.

Figure 27A:
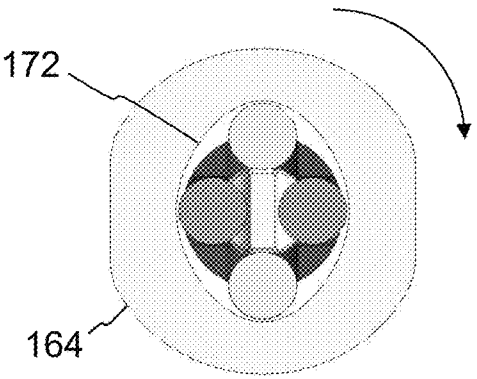
FIGS. 27A and 27B are top cross section and perspective views of the plunger in another embodiment moving upwardly.
Figure 27B:
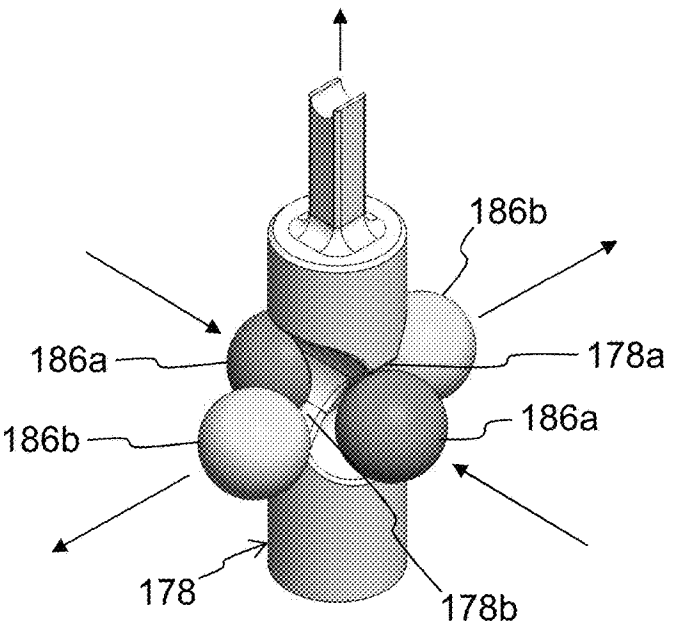
Figure 27C:
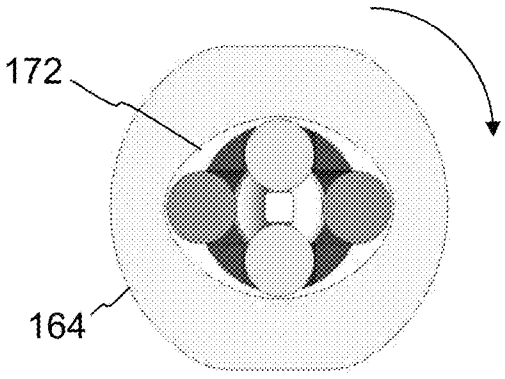
FIGS. 27C and 27D are top cross sectional and perspective views of the plunger in another embodiment moving downwardly.
Figure 27D:
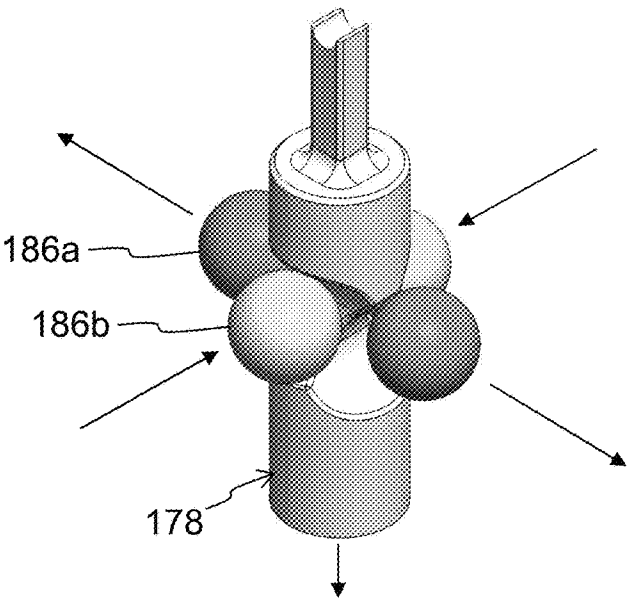

FIGS. 27A-27D illustrate a further embodiment, wherein instead of a spring or gravity used to drive the plunger 178 downwardly, rotation of sleeve 164 provides both the upward and downward force on plunger 178. Specifically, plunger 178 includes two cam surfaces 178*a* and 178*b*, that engage with ball bearings 186*a* and 186*b* respectively. The cam surface 172 of sleeve 164 is elliptical, and rotation of sleeve 164 drives ball bearings 186*a* inwardly while ball bearings 186*b* travel outwardly, and vice versa. When ball bearings 186*a* are driven inwardly, they push plunger 178 upwardly by engaging cam surfaces 178*a*, as shown in FIGS. 27A and 27B (arrows showing direction of movement). When ball bearings 186*b* are driven inwardly, they push plunger 178 downwardly by engaging cam surfaces 178*b*, as shown in FIGS. 27C and 27D (arrows showing direction of movement). This embodiment can be used with the two motor or the three motor configurations described above.

It is to be understood that the present invention is not limited to the embodiment(s) described above and illustrated herein, but encompasses any and all variations falling within the scope of any claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. Further, as is apparent from the claims and specification, not all method steps need be performed in the exact order illustrated or claimed. While plunger 178 is shown as unitary, it could instead be several distinct parts confined in cavity 168.

It should be noted that, as used herein, the terms "over" and "on" both inclusively include "directly on" (no intermediate materials, elements or space disposed there between) and "indirectly on" (intermediate materials, elements or space disposed there between). Likewise, the term "adjacent" includes "directly adjacent" (no intermediate materials, elements or space disposed there between) and "indirectly adjacent" (intermediate materials, elements or space disposed there between), "mounted to" includes "directly mounted to" (no intermediate materials, elements or space disposed there between) and "indirectly mounted to" (intermediate materials, elements or spaced disposed there between), and "engaged with" includes "directly engaged with" and "indirectly engaged with" (intermediate components connect the elements together).

What is claimed is:

1. A device for bending wire, comprising: a plate that includes: upper and lower surfaces with a center aperture extending there between, and a first pin extending from the upper surface; a shaft extending through the center aperture and terminating in a bend head, wherein the bend head includes: a wire aperture configured to pass a wire, and first and second bend surfaces positioned adjacent the wire aperture; a sleeve rotatably disposed around the shaft; a first motor configured to rotate the plate about the shaft in opposing first and second rotational directions; a second motor configured to move the plate between an extended position and a retracted position, and an intermediate position there between, along the shaft; wherein the plate positioned in the extended position and rotating in the first rotational direction causes the first pin to travel in front of the wire aperture; wherein the plate positioned in the intermediate and the retracted positions and rotating in the first rotational direction causes the first pin to travel underneath the wire aperture; wherein the plate positioned in the retracted position causes the plate to engage with the sleeve such that rotation of the plate in the first rotational direction causes rotation of the sleeve in the first rotational direction and rotation of the plate in the second rotational direction causes rotation of the sleeve in the second rotational direction; wherein the shaft includes a cavity therein in communication with second apertures in a sidewall of the shaft.

2. The device of claim 1, further comprising:

a pair of opposing wheels positioned for feeding wire through the wire aperture, wherein the plate positioned in the extended position and rotating in the first rotational direction causes the first pin to bend the wire fed through the wire aperture against the first bend surface.

3. The device of claim 2, wherein the plate positioned in the intermediate position and rotating in the second rotational direction causes the first pin to pass underneath and not engage with the wire fed through the wire aperture.

4. The device of claim 1, wherein the plate positioned in the retracted position causes one or more pins extending from the plate or the sleeve to engage with one or more cavities in the other of the plate or the sleeve.

5. The device of claim 1, wherein the sleeve including a cam surface facing the shaft, the device further comprising: a plunger disposed in the cavity and having a second cam surface and an upper surface; ball bearings each disposed in one of the apertures and between the cam surface and the second cam surface; wherein rotation of the sleeve in the first rotational direction causes the cam surface to move the ball bearings toward a center of the cavity of the shaft and engaging the second cam surface for driving the plunger upwardly in the cavity; and wherein rotation of the sleeve in the second rotational direction causes the cam surface to allow the ball bearings to move away from the center of the cavity of the shaft for allowing the plunger to move downwardly in the cavity.

6. The device of claim 5, wherein the second cam surface is a bottom surface of the plunger that is rounded, conical, convex, or pyramidal.

7. The device of claim 5, wherein the driving of the plunger upwardly in the cavity causes the upper surface of the plunger to pass through the wire aperture.

8. The device of claim 5, further comprising:

a spring disposed in the cavity and providing a downward force on the plunger.

9. The device of claim 5, wherein the cam surface has a tri-lobe shape.

10. The device of claim 5, wherein the upper surface of the plunger is concave.

11. The device of claim 5, wherein the plunger further includes a third cam surface, the device further comprising:

second ball bearings each disposed in one of the apertures and between the cam surface and the third cam surface;

wherein rotation of the sleeve in the second rotational direction causes the cam surface to move the second ball bearings toward a center of the cavity of the shaft and engaging the third cam surface for driving the plunger downwardly in the cavity.

12. The device of claim 2, wherein the sleeve including a cam surface facing the shaft, the device further comprising: a plunger disposed in the cavity and having a second cam surface and an upper surface; ball bearings each disposed in one of the apertures and between the cam surface and the second cam surface; wherein rotation of the sleeve in the first rotational direction causes the cam surface to move the ball bearings toward a center of the cavity of the shaft and engaging the second cam surface for driving the plunger upwardly in the cavity so that the upper surface of the plunger travels into the wire aperture and engages with the wire fed through the wire aperture; and wherein rotation of the sleeve in the second rotational direction causes the cam surface to allow the ball bearings to move away from the center of the cavity of the shaft for allowing the plunger to move downwardly in the cavity so that the upper surface of the plunger retreats from the wire aperture.

13. The device of claim 12, wherein the bend head includes a cutting edge adjacent the wire aperture for cutting the wire fed through the wire aperture as top surface of the plunger travels into the wire aperture.

14. The device of claim 5, further comprising:

a second ball bearing disposed in the cavity and between the ball bearings and the second cam surface of the plunger, wherein the ball bearings engage the second cam surface of the plunger via the second ball bearing.

15. A device for bending wire, comprising:

a plate that includes:

upper and lower surfaces with a center aperture extending there between, and a first pin extending from the upper surface;

a shaft extending through the center aperture and terminating in a bend head, wherein the bend head includes:

a wire aperture configured to pass a wire, and first and second bend surfaces positioned adjacent the wire aperture;

a sleeve rotatably disposed around the shaft;

a first motor configured to rotate the plate about the shaft in opposing first and second rotational directions;

a second motor configured to move the plate between an extended position and an intermediate position along the shaft;

a third motor configured to rotate the sleeve about the shaft in the opposing first and second rotational directions;

wherein the plate positioned in the extended position and rotating in the first rotational direction causes the first pin to travel in front of the wire aperture;

wherein the plate positioned in the intermediate position and rotating in the first rotational direction causes the first pin to travel underneath the wire aperture;

wherein the shaft includes a cavity therein in communication with second apertures in a sidewall of the shaft, and the sleeve including a cam surface facing the shaft;

a plunger disposed in the cavity and having a second cam surface and an upper surface;

ball bearings each disposed in one of the apertures and between the cam surface and the second cam surface;

wherein rotation of the sleeve in the first rotational direction causes the cam surface to move the ball bearings toward a center of the cavity of the shaft and engaging the second cam surface for driving the plunger upwardly in the cavity; and wherein rotation of the sleeve in the second rotational direction causes the cam surface to allow the ball bearings to move away from the center of the cavity of the shaft for allowing the plunger to move downwardly in the cavity.

16. The device of claim 15, wherein the second cam surface is a bottom surface of the plunger that is rounded, conical, convex, or pyramidal.

17. The device of claim 15, wherein the driving of the plunger upwardly in the cavity causes the upper surface of the plunger to pass through the wire aperture.

18. The device of claim 15, further comprising:

a spring disposed in the cavity and providing a downward force on the plunger.

19. The device of claim 15, wherein the plunger further includes a third cam surface, the device further comprising:

second ball bearings each disposed in one of the apertures and between the cam surface and the third cam surface;

wherein rotation of the sleeve in the second rotational direction causes the cam surface to move the second ball bearings toward a center of the cavity of the shaft and engaging the third cam surface for driving the plunger downwardly in the cavity.

20. The device of claim 15, further comprising:

a pair of opposing wheels positioned for feeding wire through the wire aperture, wherein the plate positioned in the extended position and rotating in the first rotational direction causes the first pin to bend the wire fed through the wire aperture against the first bend surface, and wherein the plate positioned in the intermediate position and rotating in the second rotational direction causes the first pin to pass underneath and not engage with the wire fed through the wire aperture.

21. The device of claim 20, wherein rotation of the sleeve in the first rotational direction causes the cam surface to move the ball bearings toward a center of the cavity of the shaft and engaging the second cam surface for driving the plunger upwardly in the cavity so that the upper surface of the plunger travels into the wire aperture and engages with the wire fed through the wire aperture, and wherein rotation of the sleeve in the second rotational direction causes the cam surface to allow the ball bearings to move away from the center of the cavity of the shaft for allowing the plunger to move downwardly in the cavity so that the upper surface of the plunger retreats from the wire aperture.

22. The device of claim 21, wherein the bend head includes a cutting edge adjacent the wire aperture for cutting the wire fed through the wire aperture as top surface of the plunger travels into the wire aperture.

* * * * *